US007578670B2

(12) United States Patent
Keiffer et al.

(10) Patent No.: US 7,578,670 B2
(45) Date of Patent: Aug. 25, 2009

(54) SELF-EXTINGUISHING CANDLE

(76) Inventors: Lisa L. Keiffer, P.O. Box 58414, Charleston, WV (US) 25358; Geovany R. Miranda, P.O. Box 58414, Charleston, WV (US) 25358

( * ) Notice: Subject to any disclaimer, the term of this patent is extended or adjusted under 35 U.S.C. 154(b) by 92 days.

(21) Appl. No.: 11/856,843

(22) Filed: Sep. 18, 2007

(65) Prior Publication Data

US 2008/0076081 A1 Mar. 27, 2008

Related U.S. Application Data

(60) Provisional application No. 60/845,935, filed on Sep. 21, 2006.

(51) Int. Cl.
*F23N 1/00* (2006.01)

(52) U.S. Cl. ..... 431/35; 431/120; 431/295; 431/325

(58) Field of Classification Search ..... 431/35, 431/295, 325, 120
See application file for complete search history.

(56) References Cited

U.S. PATENT DOCUMENTS

| | | | | |
|---|---|---|---|---|
| 1,067,184 | A | 7/1913 | Lynch | |
| 4,381,914 | A | 5/1983 | Ferguson | |
| 4,424,018 | A | 1/1984 | Lowther, Sr. | |
| 5,961,318 | A * | 10/1999 | Chambers et al. | 431/320 |
| 6,447,286 | B1 | 9/2002 | Snuggs | |
| 6,739,866 | B2 * | 5/2004 | Fang | 431/126 |
| 6,805,551 | B1 | 10/2004 | Feuer | |
| 7,040,888 | B2 * | 5/2006 | Keiffer et al. | 431/35 |
| 2003/0013060 | A1 * | 1/2003 | Schoeck | 431/288 |
| 2004/0091829 | A1 | 5/2004 | Mack | |
| 2006/0019209 | A1 * | 1/2006 | Ortiz | 431/289 |

* cited by examiner

*Primary Examiner*—Steven B McAllister
*Assistant Examiner*—Nikhil Mashruwala

(57) ABSTRACT

A self-extinguishing candle is described, comprising a candle body made of wax or other suitable fuel. One or more series of wick appliances having an internal hollow channel are longitudinally disposed within the candle body. A single length of wick traverses through the collinear channels of each series of wick appliances. Within each wick appliance the section of wick therein is formed into a wick contraction. The wick contraction may be formed by bending, folding, spiraling, coiling, gathering or furling the section of wick, thereby increasing the overall length of wick contained within the interior of each wick appliance.

12 Claims, 4 Drawing Sheets

SELF-EXTINGUISHING CANDLE

PRIOR RELATED APPLICATIONS

The applicants claim the benefit of the filing date of Provisional Application No. 60/845,935, filed Sep. 21, 2006.

BACKGROUND OF THE INVENTION

1. Field of the Invention

The present invention relates to candles, specifically to self-extinguishing candles 2. Description of the Prior Art Candles have been produced and used for centuries for lighting and, more recently, for ambiance through the use of design, color and fragrances in the candle.

However, candles, by there nature, present an open flame which can burn for many hours until the candle fuel is consumed if not extinguished. This poses a hazard of fire in the home if the residents forget or neglect to extinguish the candle flame after wanting or needing its use has ended. Left unattended, the candle may be accidentally toppled by a pet or small child, causing a fire. The candle, as it burns, reduces in height, thereby lowering the flame and exposing any combustible materials around the base of the candle to elevated temperatures.

To avoid or prevent these fire hazards, the prior art contains examples of self-extinguishing candles. Generally, these self-extinguishing candles provide a means for extinguishing the candle flame after a certain fraction of the candle and its wick section have been burnt or melted. The candle wick can later be relit, and the flame continues until the next section of wick has burned.

For example, Lynch, U.S. Pat. No. 1,067,184, describes a candle which self-extinguishes at a predetermined height above the base. The wick within the candle is split into two sections, an upper and lower sections. Between the two wick sections is a gap, large enough that a flame burning on the upper section could not ignite the lower section. A wire traverses the gap, the ends of which are wrapped around the proximate ends of the two wick sections. As the candle burns, its overall height decreases until the wax surrounding the bottom end of the upper wick section melts and that bottom end is within the pool of molten wax. At this point the wire wrapped around the two wick sections serves to support the upper wick section, as the lower section is still firmly embedded within solid wax. But once the wax pool is lowered below the bottom end of the upper wick section, no more wax can diffuse into the upper wick section and the flame extinguishes.

Lynch provides an adequate means for self-extinguishing a candle before its flame becomes too close to the surrounding surface. But, it can self-extinguish only one time and cannot self-extinguish at any earlier point.

Likewise, Ferguson, U.S. Pat. No. 4,381,914, provides a means for self-extinguishing a candle flame prior to burning too close to its base. In Ferguson, the wick passes snugly through a tubular collar and, below that, an insulating spacer. The length of the spacer, and thereby the height at which the collar is disposed, is predetermined. Once the wick burns down to and into upper edge of the collar, the surrounding molten wax flows over the wick end, smothering the flame. Like Lynch, Ferguson provides a means for safely self-extinguishing a candle at a safe height above its base and the surrounding surfaces. However, it also can not be reignited nor extinguished at any other height above the final extinguishing height.

In comparison, Snuggs, U.S. Pat. No. 6,447,286, teaches of a self-extinguishing candle which can be extinguished and reignited multiple times at intervals down the candle. The candle is comprised of a candle body and a longitudinal wick, like standard candle designs. A noncombustible collar is provided at the top surface of the candle, surrounding the wick. A series of apertures or boreholes are radially disposed at varying intervals down the height of the candle. A short rod is inserted into each borehole or aperture. The candle operates by first lighting the wick. The heat of the candle flame heats the collar, causing it to melt the immediately surrounding wax and sink down into the candle body. As the wick burns and is consumed, the collar sinks progressively lower, until the collar contacts the first set of apertures and their rods and is held at that position. The wick continues to burn downward, until it is below the top edge of the collar. The surrounding wax pool then smothers the candle flame. When the candle is desired to be relit, the first set of rods are removed, wax is removed from the interior of the collar to expose a suitable length of wick, and the wick is relit. The process described above repeats until the collar reaches the second set of apertures and rods, and is again extinguished. Snuggs teaches of a self-extinguishing candle that can extinguish and be relit multiple times down its length. However, the design is not usable in a container candle, as the radially disposed rods could not be removed through a standard container. It also requires removing wax from around the candle prior to relighting, as no portion, or an insufficient portion, of the wick remains exposed after the prior extinguishing step.

Mack, US Publication No. 2004/0091829, adopts a similar technique as Lynch, but has a plurality of wick segments along the length of the candle, each separated by a gap. However, in Mack, the gap is filled with a noncombustible, cylindrical material which supports the wick section above until it is consumed and extinguishes. The noncombustible spacer is then removed, along with an amount of wax around the upper end of the next wick segment that must be manually removed to expose a sufficient amount of wick to be reignited.

Finally, Feuer, U.S. Pat. No. 6,805,551, describes a self-extinguishing candle in which a straight, continuous wick within a candle body traverses through the open center channels of a collinear series of devices. A small detent is disposed in the top surface of each device, surrounding the channel through which the wick passes. The uppermost device is embedded at some length below the top surface of the unused candle. Once the candle is first lit, the wick burns down to the top surface of the first device. The wick burns down to the first device and into the small detent. Molten wax in the detent then extinguishes the flame. The device is then removed, exposing the next section of wick which had been within the channel of the first devices. The cone section at the top of the first device leaves a small cavity, free of wax, in the top surface surrounding the newly exposed wick, which is then suitable for relighting. This process can be repeated until the candle is consumed. However, the devices are large and expensive to manufacture, and removal of each device can fracture and mar the surface of the candle, leaving an unattractive appearance. Also, in many cases a newly lit section of wick will be smothered by the wax melting from the walls of the cavity within which the wick is disposed.

A self-extinguishing candle that presents a sufficient length of wick above the surface of resolidified wax after each cycle of use and extinguishing is desirous.

SUMMARY OF THE INVENTION

The present invention is a self-extinguishing candle comprising a series of wick appliances arranged colinearly within the body of the candle, parallel to the longitudinal axis of the candle. Each wick appliance is generally of an elongated tubular shape, defining a narrow central channel Each wick appliance may have a tab affixed to its upper end, which facilitates removal of each wick appliance, as described herein.

A single wick traverses through the series of channels of the wick appliances. However, the wick is contracted within each wick appliance, meaning that a section of wick, the extended length of which is longer than the length of the wick appliance channel, is contracted by folding, bending, curling, spiraling, gathering, furling or the like, to fit the overall longer section of wick into the length of the channel.

The present invention operates in a similar manner as Feuer. When the candle burns down to where the wick has reached the top of the first wick appliance, the impermeability of the wick appliance, together with any molten wax that may flow into the channel, will smother the flame. When the candle is next desired to be relit, the wick appliance is removed by grasping the tab and pulling upward. As the appliance is pulled upward, the wick is extracted and extended by friction with the wall of the channel, such that, when the appliance is removed, the wick section is fully extended, thereby providing a stub, or length above the surface of the surrounding candle wax, sufficient for relighting. In contrast, Feuer provides a wick stub not be extending the wick, but by creating a depression or hollow in the surrounding wax surface.

One objective of the present invention is to provide a candle which will self-extinguish and which can be relit for repeated cycles for the overall life of the candle.

Another objective is to provided a self-extinguishing candle that presents a wick of sufficient length for relighting after each extinguishing cycle.

These and other objectives and advantages of the invention will become apparent from the description which follows. In the description, reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following description, then, is not to be taken in a limiting sense, and the scope of the present invention is best defined by the appended claims.

DETAILED DESCRIPTION OF PREFERRED EMBODIMENTS

The following discussion describes in detail one or more embodiments of the invention. The discussion should not be construed, however, as limiting the invention to those particular embodiments, and practitioners skilled in the art will recognize numerous other embodiments as well. The complete scope of the invention is defined in the claims appended hereto.

Figure 1:
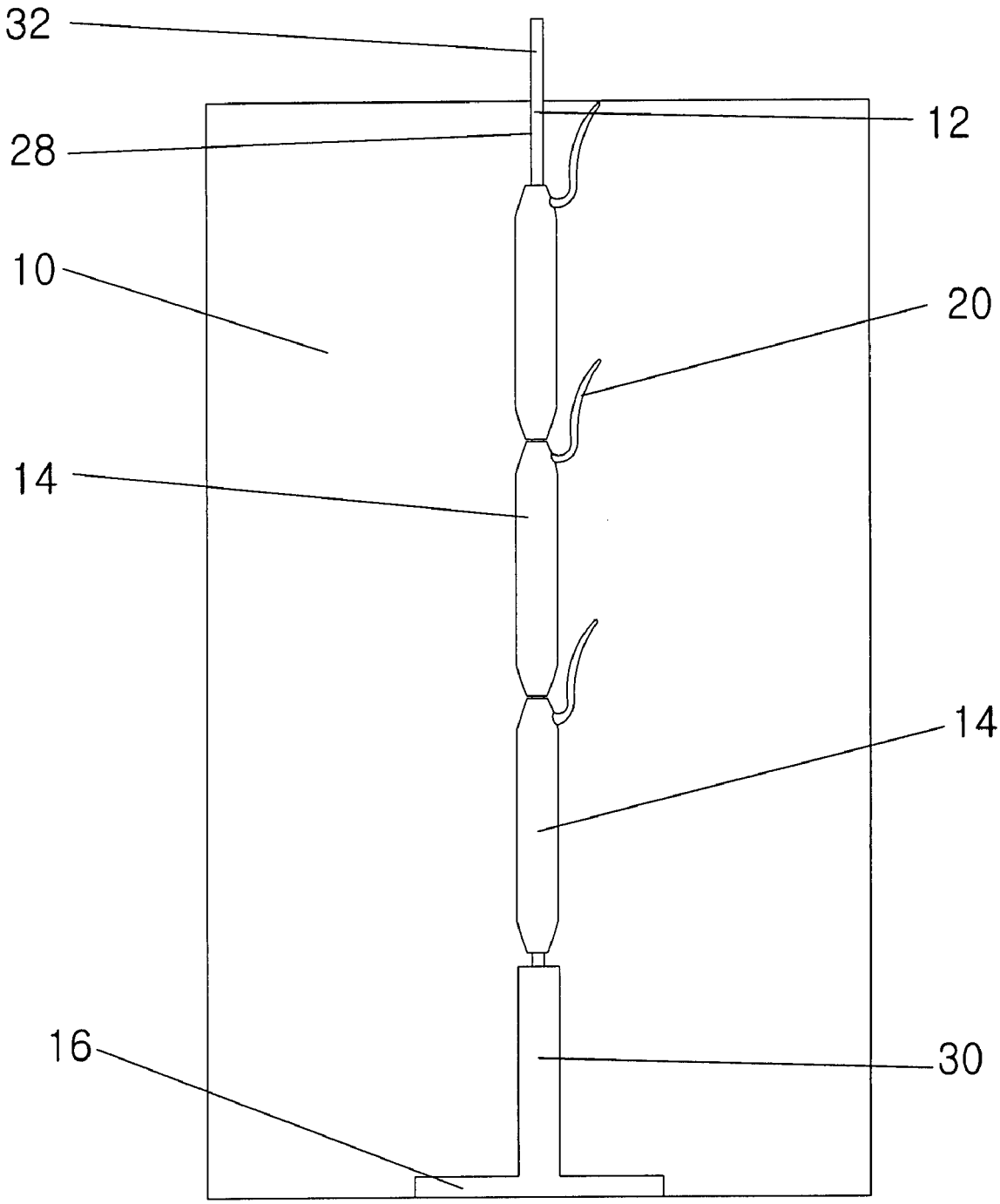
FIG. 1 is a sectional elevation view of the self-extinguishing candle.

A self-extinguishing candle, as illustrated in FIG. 1, comprises in part a candle body 10, which is comprised of a combustible material such as wax, including but not limited to paraffin wax, waxes derived from animal or insect sources, such as beeswax, shellac, lanolin wax and spermaceti wax, or from vegetable sources, such as carnuba wax, bayberry wax, candelilla wax. Synthetic waxes can also be made from ethylene glycol diesters. Like most candles, paraffin wax is the preferred material for the candle body 10.

Traversing longitudinally through the candle body 10 is a collinear series of wick appliances 14. Each wick appliance 14 is generally of a tubular shape, defining a hollow central channel 22. At the top end section of each wick appliance 14 is disposed a tab 20, providing a means for manually gripping the otherwise thin wick appliance 14. The tab 20 is slightly offset radially from the body of the wick appliance 14, thereby allowing the proximate ends of adjacent wick appliance 14 to abut without any significant gap.

The uppermost wick appliance 14 is disposed below the surface of the unused candle a depth approximately equal to the length of the wick appliance 14, without the tab 20. This provides an initial gap 28 and a wick stub 32 for an initial burn period before the candle self-extinguishes at the top of the uppermost wick appliance 14.

A single wick 12 passes through the channels 22 of the series of wick appliances 14, typically extending beyond both the lower and upper wick appliances in the series. The wick 12 may be made of cotton or other fibers typically used in the art, and may be braided or woven The wick 12 is usually impregnated with wax.

Below the lowermost wick appliance may be a base, such as a typical wick clip, to which the bottom of the wick 12 is attached and which supports the wick 12 and wick appliances 14 during candle manufacture. Alternatively, a simple tubular spacer 30 without a tab may be disposed around the section of wick 12 below the lowermost wick appliance 14 to finally extinguish the candle at a safe height above the base 16 and surrounding surface.

Figure 2:
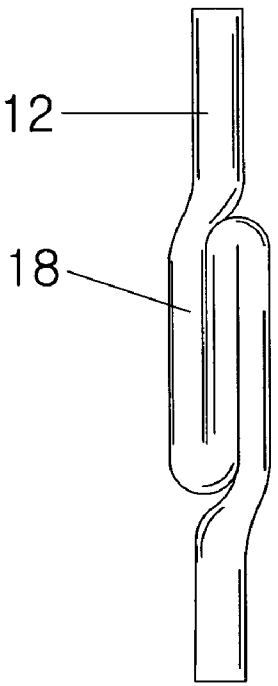
FIG. 2 is a sectional view of the wick appliance with a wick section contracted within.

As shown in FIG. 2, within the channel 22 in each wick appliance 14, the section of wick 12 passing therein forms a wick contraction 18. A wick contraction, as used herein, refers to some alteration in the geometry of an otherwise elongated, straight wick, such that a section of wick longer than the length of the channel 22 is placed within the confines of the channel 22. Some example ways of forming a wick contraction 18 within a wick appliance 14, include bending or folding, as in FIG. 3A, twisting, coiling or spiraling, as in FIG. 3B, or gathering or furling, as in FIG. 3C. These are to be understood as only examples of how a wick section may be contracted within the wick appliance. In every case, the amount of wick contained within the channel of the wick appliance 14 would be, when extended, sufficiently longer than the length of the channel 22 so as to provide a sufficiently long stub 32 to permit relighting the candle.

Figure 3C:
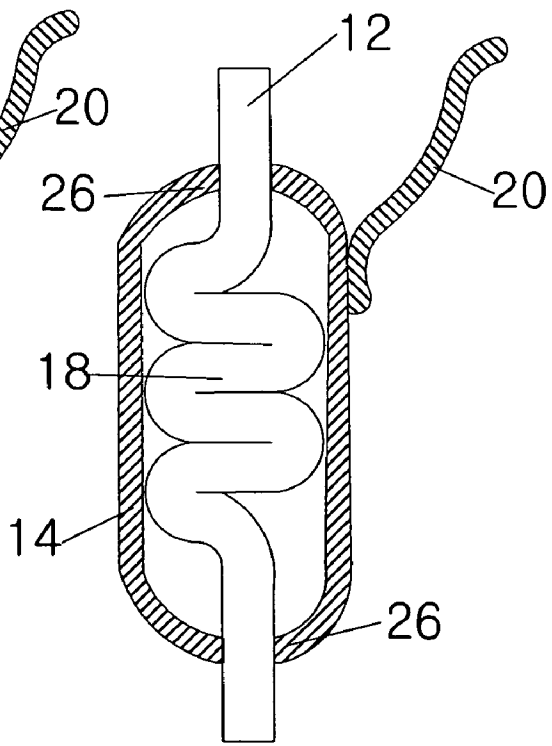
FIGS. 3A-3C are sectional views of wick appliances, illustrating means by which a wick section is contracted within the wick appliance.
Figure 3B:
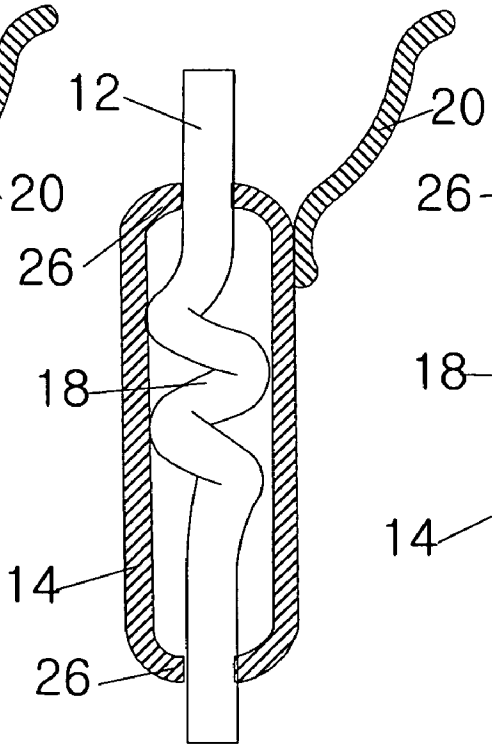
Figure 3A:
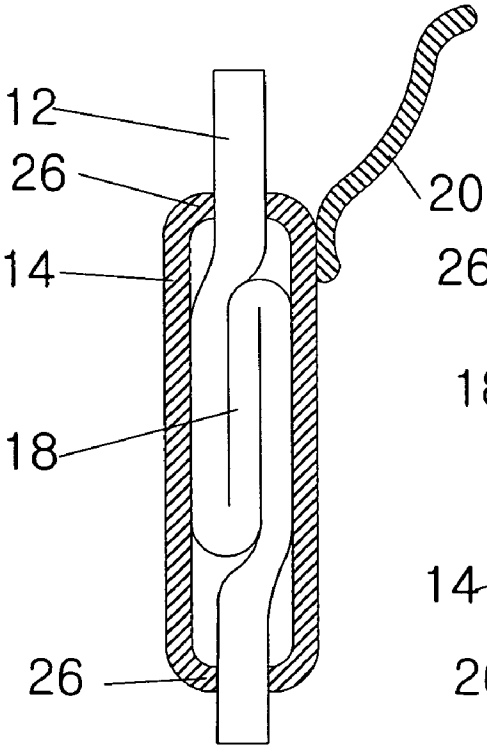
Figure 4B:
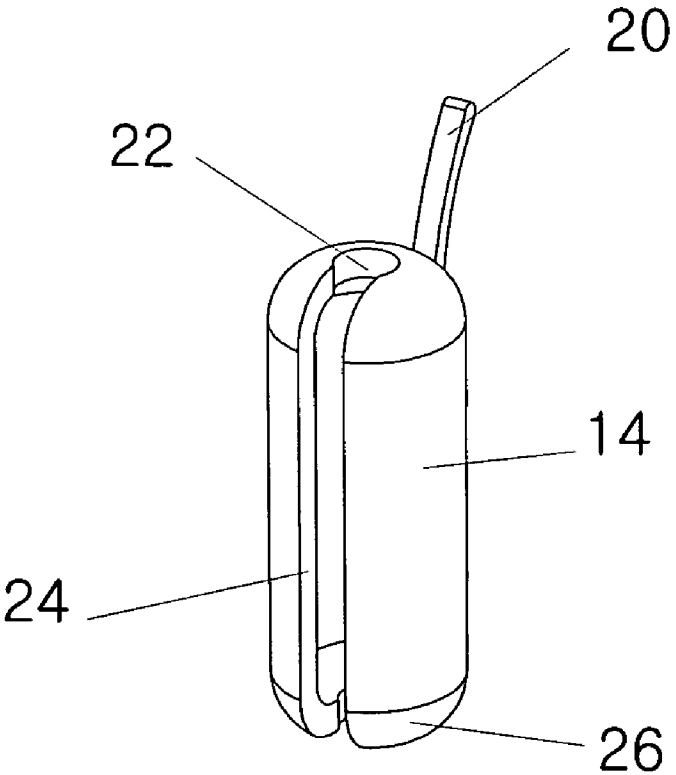
FIGS. 4A and 4B illustrate alternate embodiments of the wick appliance.
Figure 4A:
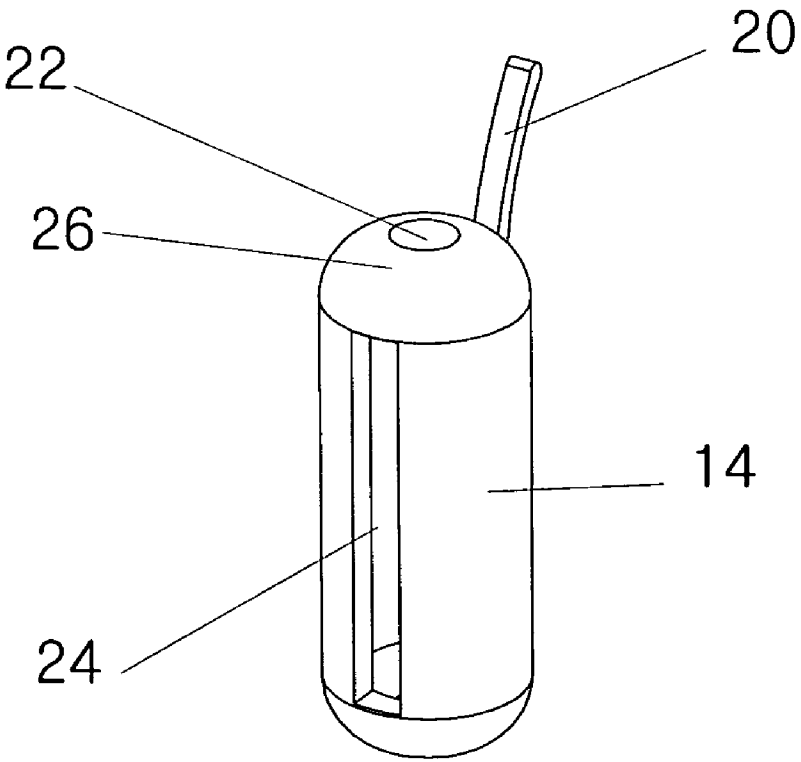

The wick appliance 14 may be completely closed circumferentially, or, as shown in FIGS. 4A and 4B, may have a slot 24 running longitudinally along some, FIG. 4A, or all, FIG. 4B, of the length of the wick appliance. The slot 24 facilitates inserting a wick section with a pre-formed wick contraction 18 into the channel 22 during the candle manufacture process, which is mechanically simpler to carry out than to form a wick contraction 18 within a closed channel 22 as shown in FIGS. 3A-3C.

The internal diameter of the channel 22 in the wick appliance 14 is slightly larger than the diameter of the straight wick 12. It is of a size to permit insertion of a wick contraction without undue radial compression of the wick 12 and wick contraction 18, and thereby provide enough friction between the interior wall of the channel 22 and the wick contraction 18 to hold the wick 12 section and wick contraction 18 in place, but not so much as to preclude removal of the wick appliance 14 from the wick 12.

If needed to secure the wick appliance to the wick, the top and/or bottom ends of the wick appliance 14 may be slightly crimped around the wick, as shown in FIGS. 3A-3C. The friction provided by the crimp 26 should be sufficiently low to allow the wick 12 to pass through without binding, abrading or tearing. A slight crimp 26 at the bottom of the wick appliance will aid in elongating and straightening the wick contraction, providing a more aesthetically pleasing wick stub 32 after removal of the wick appliance 14.

Figure 5:
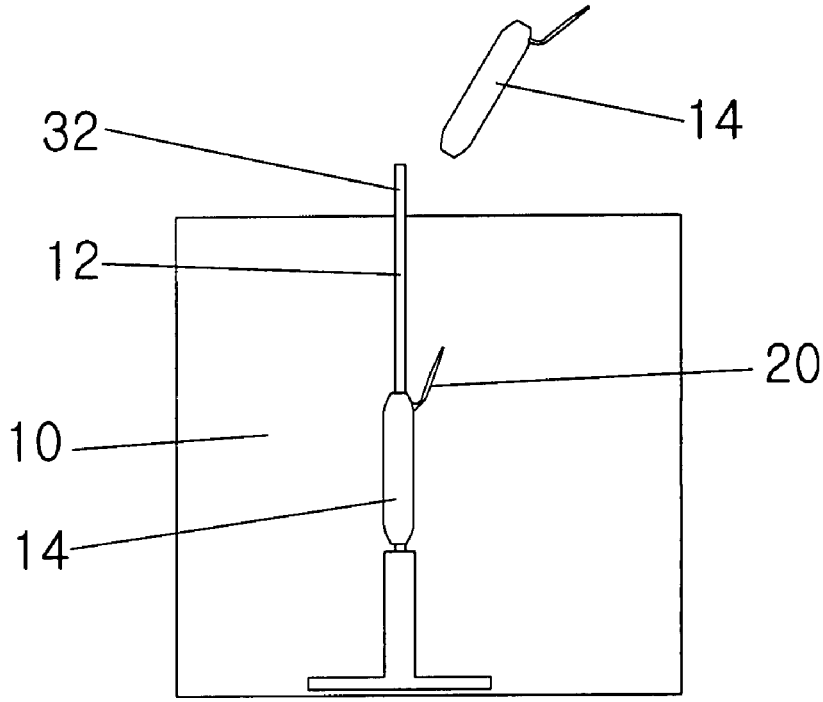
FIG. 5 illustrates an alternative embodiment of the invention with multiple series of wick appliances.

To use a self-extinguishing candle as disclosed herein, a candle is provided as shown in FIG. 1 and FIG. 5. The wick stub 32 extending beyond the upper surface of the candle is lit. Initially, the wax impregnating the wick stub 32 melts and ignites when first exposed to the flame of a match or lighter. The heat of the flame around the wick melts the wax surrounding the wick, forming a shallow pool of molten wax. Molten wax is drawn up the wick stub 32 by capillary action, where it continues to provide fuel for the candle flame. By drawing up the molten wax, the surface of the pool of molten wax lowers, thereby lengthening the wick stub 32, and extending the upper tip of the wick stub 32 higher into hotter portions of the candle flame, where the tip of the wick stub 32 is oxidized and burnt off. This process continues, gradually lowering the height of the candle body and the wick simultaneously, until the tip of the wick 12 reaches the upper end of the uppermost wick appliance 14. Once the wick 12 tip has burnt below the upper edge of the wick appliance 14, the flame is extinguished. The molten wax cools and solidifies, leaving the tab 20 exposed. When desired to relight the candle, the uppermost wick appliance can be removed by grasping the tab 20 and pulling gently upward. As shown in FIG. 5, this will cause the section of wick 12 within the wick appliance 14 to emerge and to straighten and elongate the wick contraction 18. Once the wick appliance has been removed and the wick extracted from therein, a short wick stub 32 will again be provided, emerging from the candle surface. This can then be relit, repeating the above process.

Figure 6:
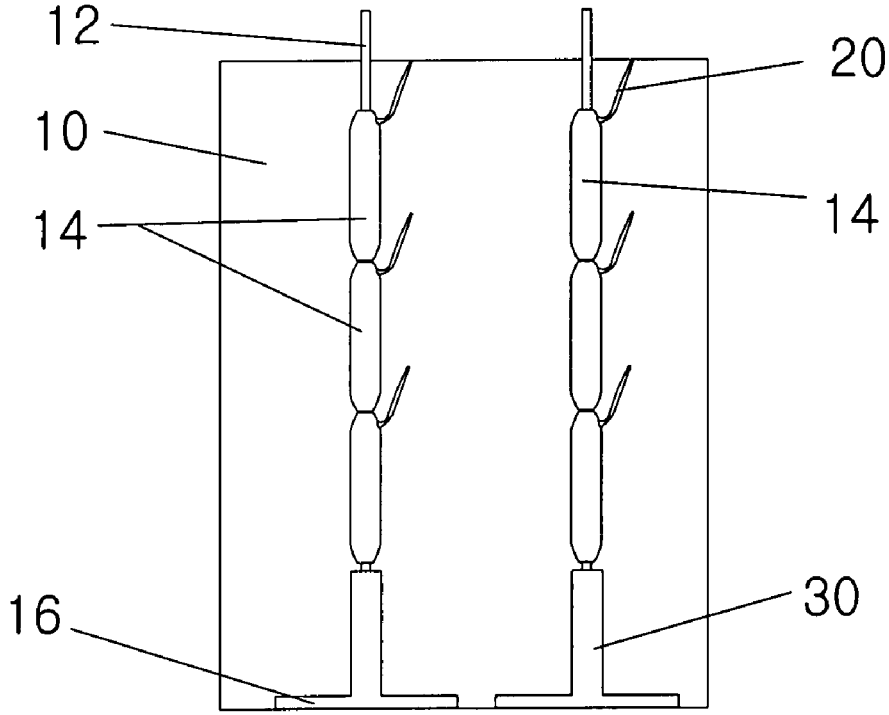

In another embodiment of the invention, shown in FIG. 6, the candle body comprises two or more series of wick appliances, with wicks disposed therein as described above.

While various embodiments of the invention have been described above, it should be understood that they have been presented by way of example, and not of limitation. It will be apparent to persons skilled in the relevant art that changes in form and detail may be made therein without departing from the spirit, scope or application of the invention. This is especially true in light of technology and terms within the relevant art that may be later developed. Thus, the present invention should not be limited by any of the above-described exemplary embodiments, but should only be defined in accordance with the appended claims and their equivalents.

We claim:

1. A self-extinguishing candle, comprising:

a candle body, comprising a combustible material;

a collinear series of wick extinguishing appliances disposed longitudinally within the candle body;

wherein each wick extinguishing appliance comprises an upper and a lower end section and defines a hollow interior channel;

a wick traversing through the interior channels of the series of wick extinguishing appliances, wherein the wick is contracted within the interior channel of each wick extinguishing appliance in the series; and wherein each wick extinguishing appliance further comprises a longitudinal slot in the wall of the wick appliance.

2. A self-extinguishing candle, comprising:

a candle body, comprising a combustible material;

one or more collinear series of wick extinguishing appliances disposed longitudinally within the candle body, wherein each wick extinguishing appliance comprises an upper and a lower end section and defines a hollow interior channel;

a wick traversing through the interior channels of each series of wick extinguishing appliances, wherein each wick is contracted within the interior channel of each wick extinguishing appliance in each series of wick extinguishing appliances; and wherein each wick appliance further comprises a longitudinal slot in the wall of the wick appliance.

3. The self-extinguishing candle of claim 2, further comprising a tab disposed on the upper end section of one or more wick extinguishing appliances in each series of wick appliances.

4. The self-extinguishing candle of claim 2, wherein the combustible material is a wax.

5. The self-extinguishing candle of claim 4, wherein the wax is paraffin wax.

6. The self-extinguishing candle of claim 4, wherein the wax is selected from the group comprising paraffin wax, wax derived from animal or insect sources, wax derived from vegetable sources, synthetic wax or mixtures of any of the foregoing waxes.

7. The self-extinguishing candle of claim 2, wherein the wick is contracted within each wick extinguishing appliance by means selected from the group of bending, coiling, curling, spiraling, gathering and furling.

8. The self-extinguishing candle of claim 1, wherein the combustible material is a wax.

9. The self-extinguishing candle of claim 8, wherein the wax is paraffin wax.

10. The self-extinguishing candle of claim 8, wherein the wax is selected from the group comprising paraffin wax, wax derived from animal or insect sources, wax derived from vegetable sources, synthetic wax or mixtures of any of the foregoing waxes.

11. The self-extinguishing candle of claim 1, wherein the wick is contracted within each wick extinguishing appliance by means selected from the group consisting of bending, folding, coiling, curling, spiraling, twisting, gathering and furling.

12. The self-extinguishing candle of claim 1, further comprising a tab disposed on the upper ends section of one or more of the wick extinguishing appliances in the series.

* * * * *